US005184952A

United States Patent [19]

Nishikawa et al.

[11] Patent Number: 5,184,952

[45] Date of Patent: Feb. 9, 1993

[54] HEAT ROLL FIXING UNIT

[75] Inventors: Tomoyuki Nishikawa, Matsudo; Ikuo Negoro, Sakado, both of Japan

[73] Assignee: Asahi Kogaku Kogyo Kabushiki Kaisha, Tokyo, Japan

[21] Appl. No.: 723,717

[22] Filed: Jun. 19, 1991

Related U.S. Application Data

[63] Continuation of Ser. No. 515,435, Apr. 27, 1990, abandoned.

[30] Foreign Application Priority Data

Apr. 28, 1989 [JP] Japan ..... 1-51541

[51] Int. Cl.[5] ..... F27B 9/28

[52] U.S. Cl. ..... 432/60; 432/59; 432/228; 219/216; 219/469

[58] Field of Search ..... 432/8, 59, 228; 219/216, 409

[56] References Cited

U.S. PATENT DOCUMENTS

| | | | |
|---|---|---|---|
| 3,794,417 | 2/1974 | Machmer . | |
| 4,077,358 | 3/1978 | Kito . | |
| 4,316,719 | 2/1982 | Motomura et al. . | |
| 4,363,549 | 12/1982 | Brown et al. . | |
| 4,384,781 | 5/1983 | Takada . | |
| 4,385,826 | 5/1983 | Itoh | 219/216 |
| 4,386,539 | 6/1983 | Motomura et al. | 432/60 |
| 4,473,290 | 9/1984 | Iwao . | |
| 4,575,221 | 3/1986 | Onoda et al. . | |
| 4,618,240 | 10/1986 | Sakurai et al. . | |
| 4,716,435 | 12/1987 | Wilson . | |
| 4,802,439 | 2/1989 | Sugimoto et al. | 355/3 FU |
| 4,870,434 | 9/1989 | Negishi et al. . | |
| 4,890,140 | 12/1989 | Negoro et al. . | |
| 4,912,490 | 3/1990 | Negoro et al. . | |
| 4,924,266 | 5/1990 | Negoro et al. . | |
| 4,949,104 | 8/1990 | Negoro et al. . | |
| 4,967,691 | 11/1990 | Chikama et al. . | |

FOREIGN PATENT DOCUMENTS

| | | |
|---|---|---|
| 3817935 | 12/1988 | Fed. Rep. of Germany . |
| 53-17342 | 2/1978 | Japan . |
| 62-212678 | 9/1987 | Japan . |

*Primary Examiner*—Henry C. Yuen

*Attorney, Agent, or Firm*—Sandler, Greenblum & Bernstein

[57] ABSTRACT

A heat roll fixing unit for fusing a toner image on a recording sheet in an image recording device is provided with a heat roller and a backup roller arranged oppositely to the heat roller. The recording sheet bearing a toner image is fed between the backup roller and the heat roller. At least one of the heat roller and the backup roller has a plurality of slits at an end thereof and a gear member having a plurality of protrusions on the inner periphery thereof is provided. The protrusions are fitted in the slits, respectively, and driving means for driving the gear member to rotate the rollers is also provided.

12 Claims, 4 Drawing Sheets

HEAT ROLL FIXING UNIT

This application is a continuation of application number 07/515,435, filed Apr. 27, 1990, now abandoned.

BACKGROUND OF THE INVENTION

The present invention relates to a heat roll fixing unit for fusing an unfixed toner image and fixing it on a recording sheet by biasing and pressing a backup roll to cause the sheet against the heat roller to be heated and holding the recording sheet bearing the toner therebetween.

Copying machines, electrophotographic printers (laser printers and the like) are well known as imaging apparatus utilizing the so-called electrophotographic system for forming a latent image by exposing the circumferential surface of a photoconductive drum to light, making toner stick to the latent image to develop an image, and transferring the toner image to a recording sheet and then fixing the toner image thereto by means of fixing unit.

There are many methods of fixing toner on recording sheet in a electrophotographic system, including those by means of heat-fusion, the use of a solvent medium, pressure and the like. However, the heat-fusion method is generally employed as safest and most reliable. Among the heat-fusion methods, ther is the frequently employed so-called heat roll method of fixing the heat-fusing toner with heat applied by a heat roller while abutting and pressing a recording sheet bearing an unfixed toner image against the heated roller (heat roller).

The heat roll fixing method comprises the steps of providing a pair of fixing rollers which consists of a heat roller heated to high temperatures by a heat source such as a built-in halogen lamps or the like and a backup roller made of elastic material such as silicon rubber and press-biased thereagainst a predetermined pressure. A recording sheet bearing unfixed toner is held between the pair of rollers, and the toner is fixed by means of heat generated from the heat roller. In general, the heat roller is driven to rotate the backup roller and the recording sheet is fed by the rotation of the pair of fixing rollers.

The rotational drive of the heat roller is normally derived from a gear fixedly mated with the end thereof. Due to the fact that the heat roller is in the form of cylinder whose hollow inside has to contain a heating means (heating source), the gear is fixed to the heat roller as shown in FIG. 1.

More specifically, a slit 1A is formed on one side edge face of a heat roller 1, whereas a protrusion 2A having a predetermined mating tolerance to the slit 1A is formed in the inner periphery of a gear 2 to be mated with the heat roller 1. The protrusion 2A is fitted in the slit 1A to fixedly mate the gear 2 with the heat roller 1. In other words, by forming the slit 1A, equivalent to a key groove, at one end of the heat roller 1, and the protrusion 2A, equivalent to a key, is formed on the inner periphery of the gear 2, whereby the protrusion 2A is fixedly fitted in the slit 1A. The heat roller 1 is generally made of aluminum alloy and the gear 2 of resin such as PPS (polyphenylene sulfide) offering excellent heat resistance and mechanical properties (abrasion resistance, etc.) and suitable for integrally molding the protrusion 2A. Numeral 5 in FIG. 1 denotes a drive gear for transmitting rotational drive force by engaging with the gear 2.

With the heat roller 1 made of aluminum alloy and the gear 2 fixedly fitted thereto and made of resin, however, the heat roller 1 is heated at high temperatures (180° C.-200° C.). Because of the difference in thermal expansion coefficient therebetween (that of resin being greater), the dimensional error of the mating portion tends to increase and the mating portion also tends to become softened. With the drive force applied in such a condition, serious problems arise including deformation of the gear 2, as shown by an imaginary line "S" of FIG. 1B, into a shape close to an ellipse with a line segment "X—X" as its long axis passing through the center of rotation apart from the protrusion 2A (the section blocking relative rotation of the gear with respect to the heat roller 1) by a predetermined angle and, as a result, a periodic change in rotation speed or, in the worst case, malfunction of the motor used as the drive source caused by increased drive resistance.

In the case where a continuous form is used as a recording sheet to be carried by a fixing unit, line space dislocation in printing, irregularity in the half-tone section when an image is formed and other disadvantages occur as the speed of conveying the continuous form changes.

SUMMARY OF THE INVENTION

It is therefore an object of the present invention to provide a heat roll fixing unit capable of driving a heat roller to rotate at a constant conveying speed while preventing excessive deformation of the gear.

For the above objects, according to the invention, there is provided a heat roll fixing unit for fusing a toner image on a recording sheet in an image recording device, comprising:

a heat roller and a backup roller oppositely arranged to said heat roller. The recording sheet bearing an unfixed toner image fed between the backup roller and the heat roller. A means for pressing the backup roller against the heat roller is also provided;

a heat roller;

a backup roller oppositely arranged to said heat roller, said recording sheet bearing unfixed toner image being fed between said backup roller and said heat roller;

means for pressing said backup roller against said heat roller; and at least one gear member having a hole is engaged with one end of one of the heat roller and the backup roller. Thus, the inner periphery of the gear member and the outer periphery of the one end of the one of rollers has a plurality of predetermined engagement portions arranged in the rotational direction of said one of rollers such that the rotation of the gear member is transmitted to the one of rollers.

Driving means are provided for driving the gear member to rotate the backup roller as well as the heat roller.

DESCRIPTION OF THE ACCOMPANYING DRAWINGS

DESCRIPTION OF THE EMBODIMENTS

Figure 2A:
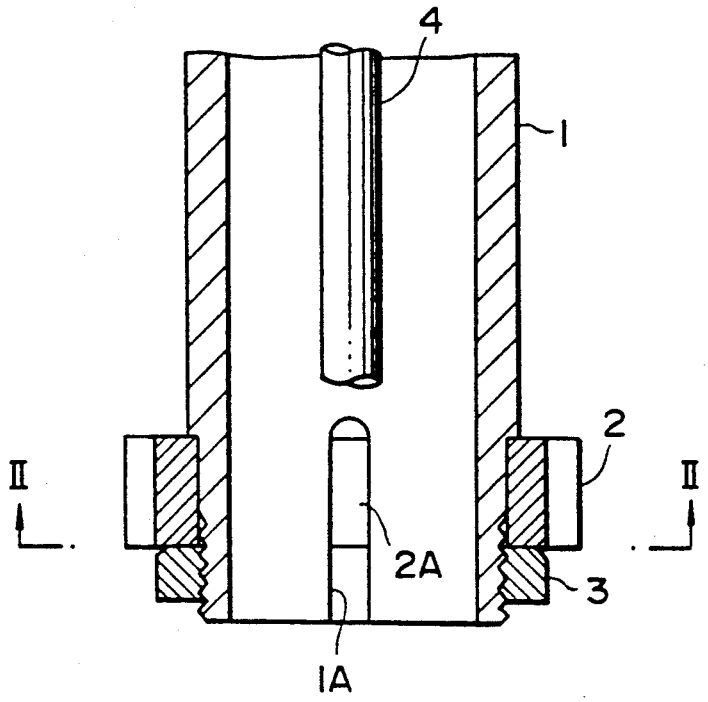
FIG. 2A is a longitudinal sectional view of a heat roller and a gear fitting thereto embodying the present invention.
Figure 2B:
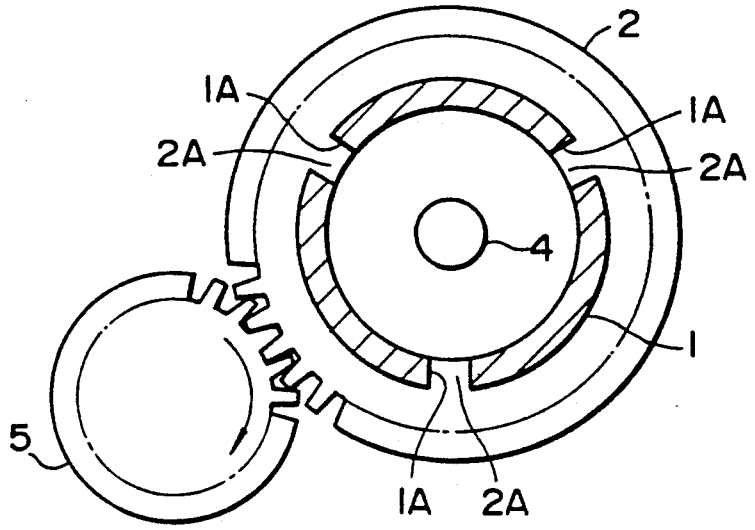
FIG. 2B is a sectional view taken on line II—II of FIG. 2A.
Figure 3:
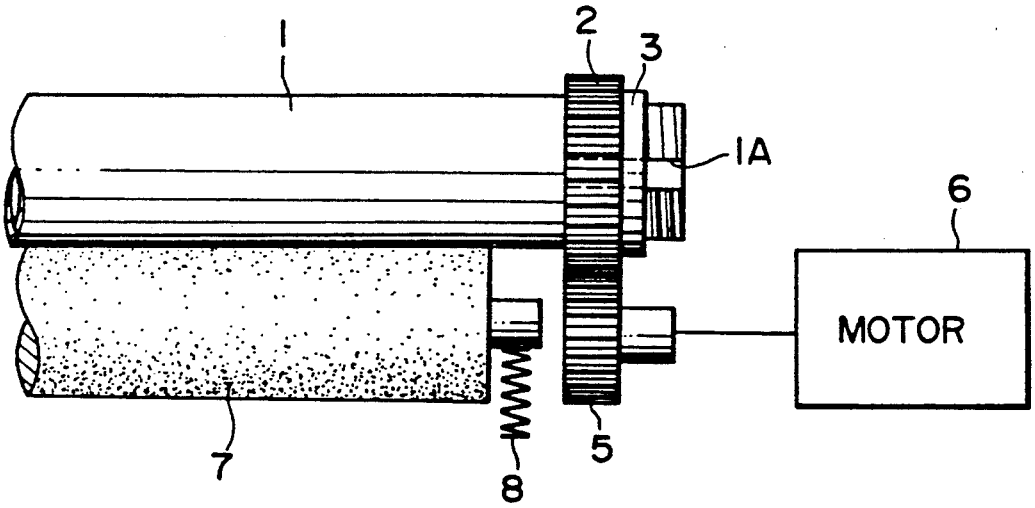
FIG. 3 is a partial front view of the heat roller fixing unit embodying the present invention.

FIG. 2A is a longitudinal sectional view of a heat roller and a gear fitting thereto embodying the present invention; FIG. 2B is a sectional view taken on line II—II of FIG. 2A, and FIG. 3 is a front view thereof.

A heat roller 1 is a cylindrical roller made of aluminum alloy with a built-in halogen lamp 4 as a heat source. Slits 1A having predetermined width and length are respectively formed in three positions constituting the circumferential edge surface of the heat roller 1.

Figure 1A:
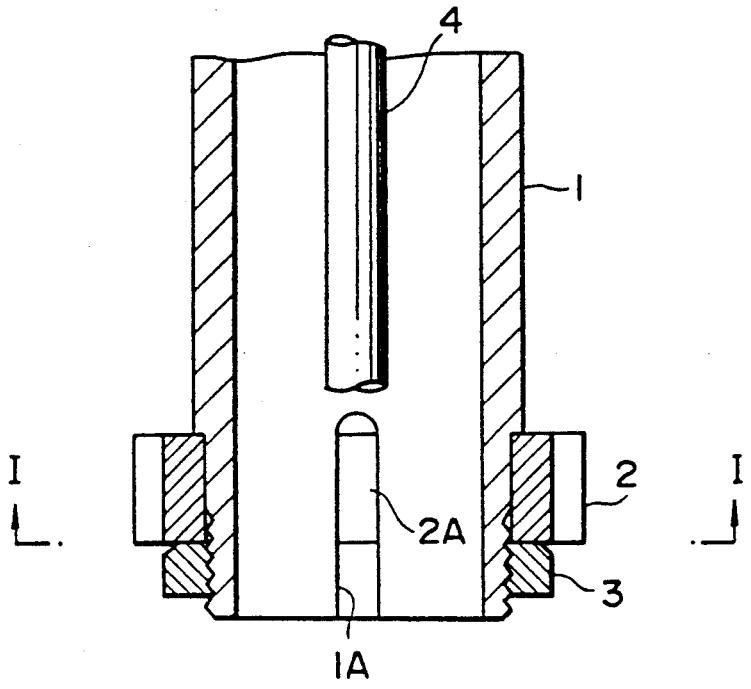
FIG. 1A is a longitudinal sectional view of a conventional heat roller and a gear fitting thereto.
Figure 1B:
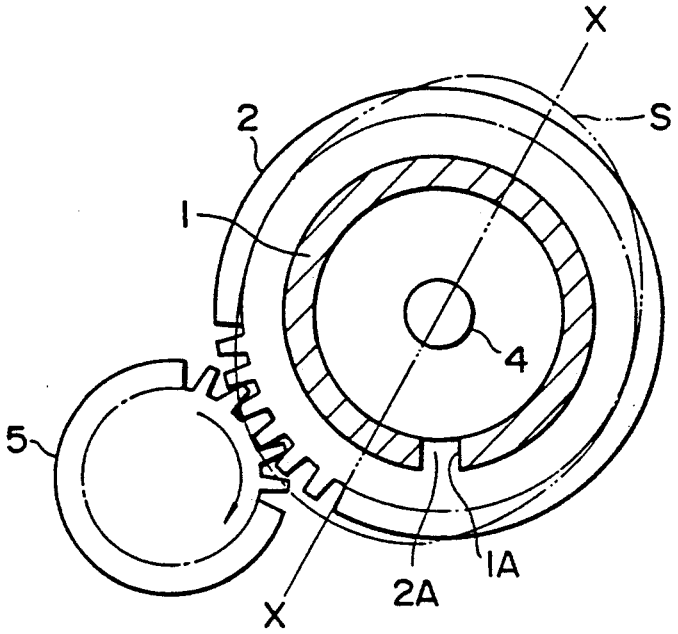
FIG. 1B is a sectional view taken on line I—I of FIG. 1A.

The gear 2 is a so-called spur gear made of PPS by integral molding and has a hole mating with the outer periphery of the heat roller 1 with a predetermined mating tolerance. Protrusions 2A mating with respective slits 1A of the heat roller 1 with a predetermined tolerance are formed on the inner periphery of the hole at three places corresponding to the slits 1A (i.e., places dividing the inner periphery thereof). Similar to the prior art of FIG. 1B, the gear 2 is engaged with the gear 5 and the driving force of a motor 6 is transmitted thereto.

A backup roller 7 is provided opposite to the heat roller 1 and press biassed toward the heat roller 1 the resilient force of a spring 8 as a biassing means.

The gear 2 makes the protrusions 2A fit into the respective slits 1A of the heat roller 1 and causes the inner periphery to mate with the outer periphery of the heat roller 1. A locknut 3 is screwed on the outer end of the heat roller 1 protruding outward from the side edge face of the gear to fix the gear to the gear 2.

With this arrangement, even when a mating error increases as the gear 2 expands because of heat, the slits 1A fit on the respective protrusions 2A at three places equally dividing the outer periphery and relative rotation therebetween is prevented at these three mating places. The stress applied to each of the relative rotation blocking sections (three mating sections) is reduced to one third, compared with a case where only one mating section is provided. The deformation of the gear 2 is thus equalized over the whole circumference, whereby the deformation can be made uniform and minimized. The heat roller 1 is driven to rotate at constant speed as the rotational peripheral speed and the rotational resistance are prevented from changing and increasing, respectively.

Figure 4A:
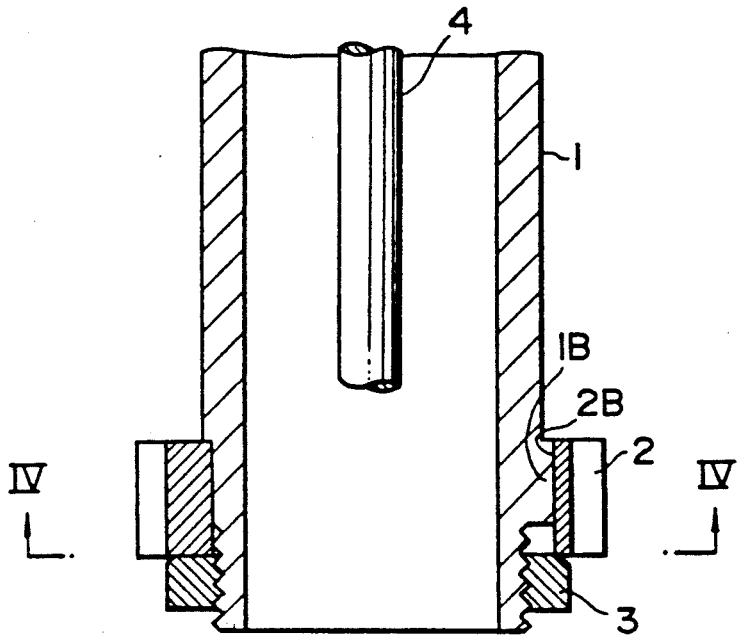
FIG. 4A is a longitudinal sectional view of a modification of the embodiment.
Figure 4B:
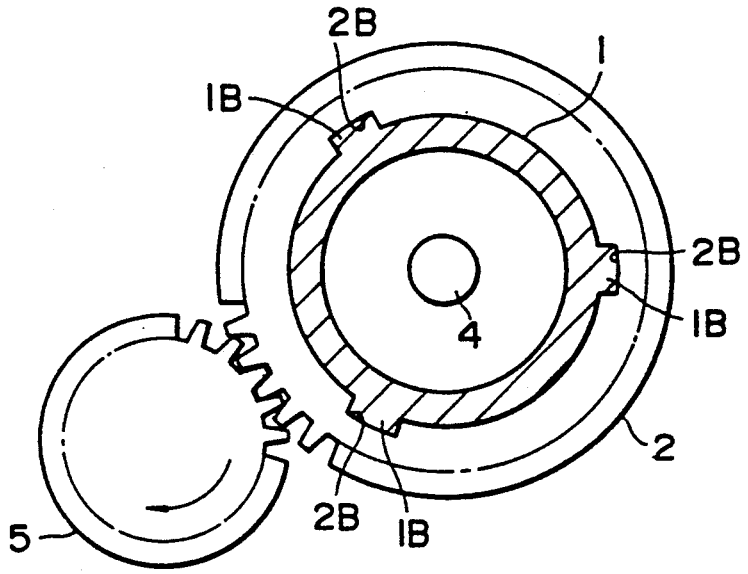
FIG. 4B is a sectional view taken on line IV—IV of FIG. 4A.

FIG. 4A is a longitudinal sectional view of a modification of the embodiment of the present invention, and FIG. 4B is a sectional view taken on line IV—IV of FIG. 4A.

In this modification, protrusions 1B having predetermined width and length are respectively formed in three positions constituting the circumferential edge surface of the heat roller 1.

The gear 2 has an interior hole mating with the outer periphery of the heat roller 1 with a predetermined mating tolerance, and grooves 2B to be engaged with respective protrusions 1B of the heat roller 1 with a predetermined tolerance are formed on the inner periphery of the hole at three places corresponding to the protrusions 1B (i.e., places dividing the inner periphery thereof). Similar to the embodiment shown in FIG. 2, the gear 2 is engaged with the gear 5 and the driving force of a motor 6 is transmitted thereto.

Although the slits 1A and the protrusions 2A (FIG. 2), or protrusions 1B and grooves 2B (FIG. 4) have been formed at three places equally dividing the circumference where the heat roller 1 mates with the gear 2 in the embodiments shown, the present invention is not limited to this arrangement but applicable to the provision of more than two sets of protrusions and grooves as occasion demands.

As set forth above, even though the mating error increases when heat is added by the heat roller to apply drive force to the gear, which is softened thereby in the heat roll fixing structure according to the present invention, the stress applied to the relative rotation blocking sections (mating sections) of the heat roller is dispersed and prevented from concentrating. As a result, the deformation of the heat roller can be minimized over the whole circumference, whereas the rotational peripheral speed and the rotational resistance of the heat roller are prevented from changing and increasing, respectively. The heat roller can thus be driven to rotate at constant speed.

What is claimed is:

1. A heat roll fixing unit for fusing a toner image on a recording sheet in an image recording device, comprising:

a heat roller;

a backup roller oppositely arranged to said heat roller, the recording sheet bearing an unfixed toner image being fed between said backup roller and said heat roller;

means for pressing said backup roller against said heat roller;

at least one gear member having a hole defining an inner periphery in which one end of one of said heat roller and said backup roller is fitted, and an outer circumference, wherein said inner periphery of said gear member and the outer periphery of said one of said rollers have a plurality of predetermined engagement portions arranged in the rotational direction of said one of said rollers such that the rotation of said gear member is transmitted to said one of said rollers, said predetermined engagement portions comprise a plurality of slits and a plurality of protrusions engaged with each other;

driving means for driving said gear member to rotate said backup roller as well as said heat roller; and whereby deformation of said gear member due to the force applied to said engagement portions is at least minimized or made substantially uniform about the outer circumference of said gear member.

2. The heat roll fixing unit according to claim 1, wherein said one of said rollers has said slits on the circumferential surface thereof at the portion at least one at end thereof, and said gear member has said protrusions, positioned corresponding to said slits, respectively, on said inner periphery thereof.

3. The heat roll fixing unit according to claim 1, wherein said engagement portions equally divide said inner periphery of said gear member and the circumferential surface of said one of rollers said in the rotational direction of said one of rollers said.

4. The heat roll fixing unit according to claim 2, wherein said slits are formed at the positions equally dividing the circumferential surface of said roller into three segments in the rotational direction thereof, and said protrusions are arranged at positions on said inner peripheral surface of said gear member corresponding to said slits.

5. A heat roll fixing unit in accordance with claim 1, wherein said engagement portions comprise means for equalizing gear member deformation about its entire circumference.

6. A heat roll fixing unit in accordance with claim 1, wherein said engagement portions comprise means for making gear member deformation uniform, and for minimizing said deformation, about the outer circumference of said gear member.

7. A heat roll fixing unit for fusing a toner image on a recording sheet in an image recording device, comprising:

a heat roller;

a backup roller oppositely arranged to said heat roller, the recording sheet bearing an unfixed toner image being fed between said backup roller and said heat roller;

means for pressing said backup roller against said heat roller;

at least one gear member having a hole defining an inner periphery in which one end of one of said heat roller and said backup roller is fitted, and an outer circumference, wherein said inner periphery of said gear member and the outer periphery of said one of said rollers have a plurality of predetermined engagement portions arranged in the rotational direction of said one of said rollers such that the rotation of said gear member is transmitted to said one of said rollers, wherein said predetermined engagement portions are formed such that a plurality of grooves are formed on said inner peripheral surface of said gear member and a plurality of protrusions corresponding to said grooves are formed on the circumferential surface of said heat roller;

driving means for driving said gear member to rotate said backup roller as well as said heat roller; and whereby deformation of the gear member due to the force applied to said engagement portions is at least minimized or made substantially uniform about the outer circumference of said gear member.

8. The heat roll fixing unit according to claim 7, wherein said protrusions are arranged at the positions equally dividing the circumferential surface of said roller into three segments in the rotational direction thereof, and said grooves are formed at the positions on said inner peripheral surface of said gear member corresponding to said slits.

9. A heat roll fixing unit for fusing a toner image on a recording sheet in an image recording device, said unit comprising:

a heat roller;

a backup roller arranged opposite said heat roller, the recording sheet bearing an unfixed toner image being fed between said backup roller and said heat roller;

means for pressing said backup roller and said heat roller to contact each other;

at least one gear member having a central aperture defining an inner periphery in which one end of one of said rollers is fitted, wherein said gear member and said one of said rollers are interfittedly engaged with each other at a plurality of predetermined engagement portions arranged in the rotational direction of said one of said rollers, such that rotation of said gear member is transmitted to said one of said rollers, said predetermined engagement portions comprising a plurality of slits and a plurality of protrusions engaged with each other; and driving means for driving said gear member to rotate said backup roller and said heat roller.

10. The heat roll fixing unit according to claim 9, wherein said plurality of predetermined engagement portions is substantially uniformly arranged in the rotational direction of said one of said rollers.

11. The heat roll fixing unit according to claim 9, said plurality of predetermined engagement portions comprising means for equalizing gear member deformation about a circumference of said gear member.

12. The heat roll fixing unit in accordance with claim 9, said plurality of predetermined engagement portions comprising means for making gear member deformation uniform, and for minimizing said deformation about a circumference of said gear member.

* * * * *

UNITED STATES PATENT AND TRADEMARK OFFICE

CERTIFICATE OF CORRECTION

PATENT NO. : 5,184,952
DATED : February 9, 1993
INVENTOR(S) : T. NISHIKAWA et al.

It is certified that error appears in the above-indentified patent and that said Letters Patent is hereby corrected as shown below:

At column 4, line 64 (claim 3, line 4), change "rollers said" to ---said rollers---.

At column 4, line 65 (claim 3, line 5), change "rollers said" to ---said rollers---.

Signed and Sealed this

Eighth Day of October, 1996

Bruce Lehman

*Attest:*

BRUCE LEHMAN

*Attesting Officer*

*Commissioner of Patents and Trademarks*